US006554451B1

(12) United States Patent
Keuper

(10) Patent No.: US 6,554,451 B1
(45) Date of Patent: Apr. 29, 2003

(54) LUMINAIRE, OPTICAL ELEMENT AND METHOD OF ILLUMINATING AN OBJECT

(75) Inventor: Matthijs H. Keuper, Best (NL)

(73) Assignee: Lumileds Lighting U.S., LLC, San Jose, CA (US)

( * ) Notice: Subject to any disclaimer, the term of this patent is extended or adjusted under 35 U.S.C. 154(b) by 6 days.

(21) Appl. No.: 09/645,939

(22) Filed: Aug. 25, 2000

(30) Foreign Application Priority Data

Aug. 27, 1999 (EP) ..... 99202774

(51) Int. Cl.[7] ..... F21V 5/02
(52) U.S. Cl. ..... 362/237; 362/244; 362/340
(58) Field of Search ..... 362/236, 237, 362/240, 244, 246, 330, 339, 333, 334, 340, 800

(56) References Cited

U.S. PATENT DOCUMENTS 1,430,580 A * 10/1922 Old ..... 362/333
1,478,680 A * 12/1923 Soderberg ..... 362/333
5,477,436 A * 12/1995 Bertling et al. ..... 362/244
5,575,549 A * 11/1996 Ishikawa et al. ..... 362/330
5,806,969 A * 9/1998 Rosengren ..... 362/237
6,244,728 B1 * 6/2001 Cote et al. ..... 362/800

FOREIGN PATENT DOCUMENTS

| | | |
|---|---|---|
| FR | 2 247 672 A | 10/1973 |
| FR | 2 740 535 A | 10/1995 |
| GB | 2 329 011 A | 3/1999 |
| WO | WO 99/50596 A | 10/1999 |

* cited by examiner

*Primary Examiner*—Y. My Quach-Lee
(74) *Attorney, Agent, or Firm*—Patent Law Group LLP; Rachel V. Leiterman

(57) ABSTRACT

A luminaire comprising a set of light sources, in particular LEDs, which are arranged predominantly in a first plane, and a set of substantially identical optical sources arranged predominantly in a second plane extending parallel to the first plane. The position of one of the light sources with respect to an optical clement opposite said light source differs from the position of a further light source with respect to an optical element opposite said light source.

11 Claims, 2 Drawing Sheets

LUMINAIRE, OPTICAL ELEMENT AND METHOD OF ILLUMINATING AN OBJECT

BACKGROUND

1. Field of Invention

The invention relates to a luminaire comprising a set of light sources and a set of optical elements. The luminaire in question is one wherein, in particular, the light sources consist of light-emitting diodes (LEDs).

2. Description of Related Art

Luminaires using light emitting diodes can be used, for example, as a street lighting or to illuminate objects in shop-windows. As LEDs are becoming more and more efficient and powerful, the possibilities of using LEDs for said purposes are continuously increasing, whereby the number of LEDs necessary for the required light output is continually decreasing. It is known to position each LED behind an optical element or lens of its own, so that the light of each LED can be directed at the street or object to be illuminated.

A drawback of such a luminaire resides in that the light distribution of a separate LED with the associated lens often is not uniformly distributed, which is caused by the fact that the LED's incident light on the lens is not uniformly distributed. Since the total light beam is a sum of these individual, not uniformly distributed light beams, the end result too is an uniformly distributed light beam.

It is an object of the invention to alleviate the above drawbacks and to provide a luminaire with a more uniformly distributed light beam.

SUMMARY

To achieve this, the luminaire in accordance with the invention comprises a set of light sources which are predominantly situated in a first plane, and a set of substantially identical optical elements which are predominantly situated in a second plane which is substantially parallel to the first plane, the position of at least one light source with respect to an optical element opposite said light source differing from the position of one of the other light sources with respect to an optical element opposite said other light source. As the position of the individual LEDs with respect to the optical element directing the light thereof is always different, the effect is the same as that obtained when one optical element is illuminated in different places by different LEDs. Therefore, the result is a more uniformly distributed light incidence on the optical elements and hence a more uniformly distributed outgoing light beam. Another advantage of the invention resides in that the number of light sources can be selected independently of the number of optical elements. As a result, the light intensity of the luminaire can be more readily adapted by adding or removing light sources, or by switching them on or off, without the desired light pattern being influenced.

Preferably, the set of light sources and the set of optical elements each form a matrix, which matrices have substantially equal dimensions, while the number of rows and/or columns of two matrices are different. An embodiment wherein the number of rows and/or columns of one matrix exceeds the number of rows and/or columns of the other matrix by one yields a good result in practice. By means of such a matrix arrangement, a luminaire can be obtained which can be readily manufactured.

Preferably, the light sources are collimated light sources. By so directing the light from each LED that parallel beams are obtained, by means of reflection and/or refraction, before it is incident on the set of optical elements, a more accurate light distribution of the outgoing beam can be attained.

Preferably, the optical elements are rectangular, and border on each other over at least a part of their circumference. By virtue thereof, it can be ensured that the entire light beam emitted by the set of LEDs passes the set of optical elements, so that no light is lost.

Preferably, the optical elements are provided, on one or both sides, with facets having different angles of inclination. The angles of inclination are preferably calculated from the illumination pattern with which the object should be illuminated. By virtue thereof, it is possible to bring about a very complex and accurate light distribution to meet the particular requirements of the user. Such optical elements even enable text to be projected.

In a preferred embodiment, the optical elements have a sawtooth structure, the facets being formed by substantially parallel prisms. A prism, viewed in a direction in the plane of the optical element, preferably has curved sides. Such prisms can be readily provided on a lens or a lens matrix by means of metal-removing tools.

The invention also relates to an optical element which is provided, on one or both sides, with facets, which facets have different angles of inclination.

The invention also relates to a method of illuminating an object, wherein a set of light sources are positioned predominantly in a first plane, and a set of substantially identical optical elements are positioned predominantly in a second plane which is substantially parallel to the first plane, at least one light source being arranged with respect to an optical element opposite said light source, in a position which differs from the position of one of the other light sources with respect to an optical element opposite said other light source.

These and other aspects of the invention will be apparent from and elucidated with reference to the embodiments described hereinafter.

DETAILED DESCRIPTION

Figure 1:
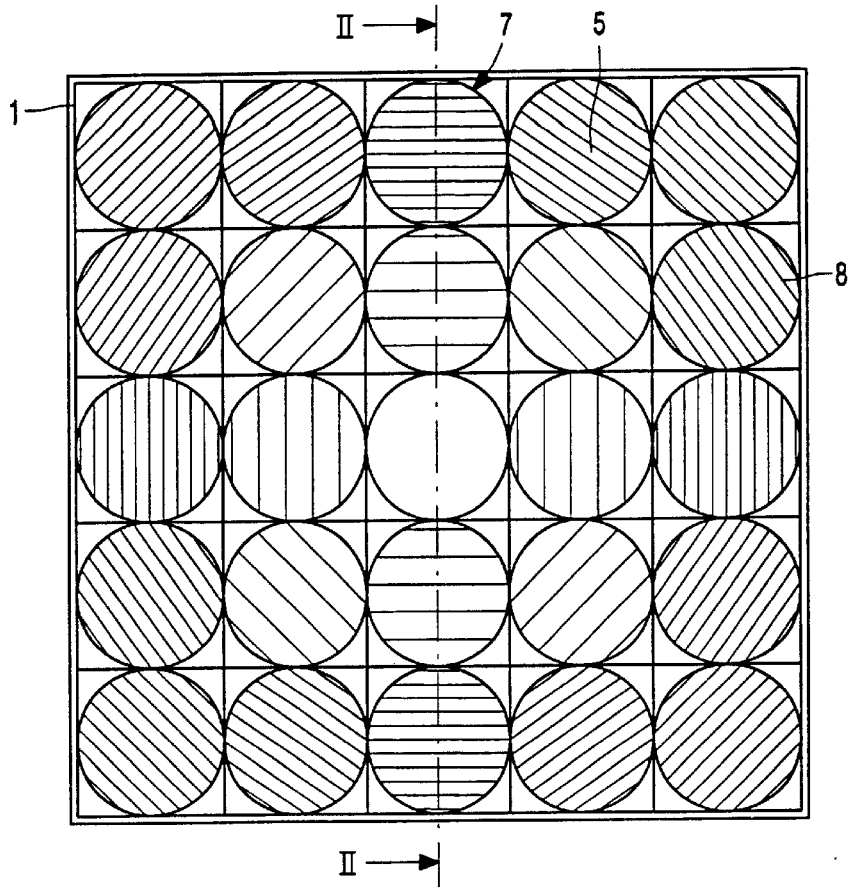
FIG. 1 (Prior Art)
FIG. 1 is a diagrammatic plan view of a known luminaire.
Figure 2:
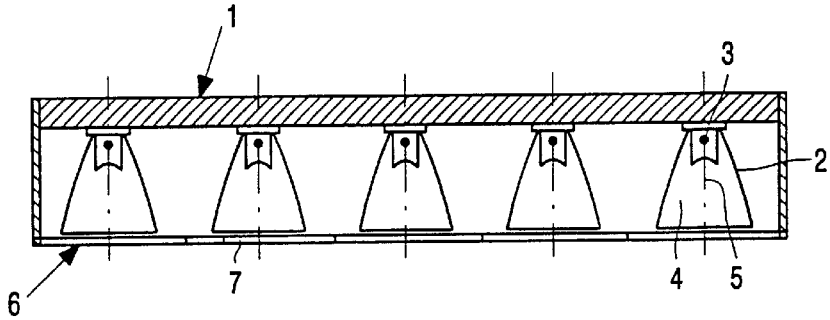
FIG. 2 (Prior Art)
FIG. 2 is a sectional view, taken on the line II—II, of the luminaire shown in FIG. 1.

FIG. 1 diagrammatically shows a plan view of a known luminaire, and FIG. 2 is a cross-sectional view thereof, taken on the line II—II. The luminaire comprises a box-shaped housing 1 accommodating 25 LED modules 2. These modules each include a light-emitting diode (LED) 3 and a collimator lens 4, which brings the rays of the LED into a parallel beam by means of reflection and refraction. The outgoing parallel light beam extends substantially parallel to the axis of symmetry 5 of the LED module 2. Each of these LED modules 2 has an axis of symmetry 5, which axes extend in mutually parallel directions.

The housing 1 has a cover 6 which is provided with 25 optical elements or lenses 7 whose axes of symmetry coincide with the axes of symmetry 5 of the LED modules 2. The exit plane of each lens 7 is provided with a sawtooth-shaped structure 8 for deflecting the outgoing light generated by the relevant LED 3. The individual lenses 7 may be oriented such that the deflected beams extend in parallel directions. It is alternatively possible, however, to orient individual lenses 7 in such a manner that a different, desired illumination pattern is obtained, as is shown, for example, in FIG. 1. Moreover, sawtooth-shaped structures having a different deflection power may also be used, for the different LED modules 2. It is alternatively possible to apply different types of LEDs 3, so that a desired color and/or intensity pattern can be obtained.

Figure 3:
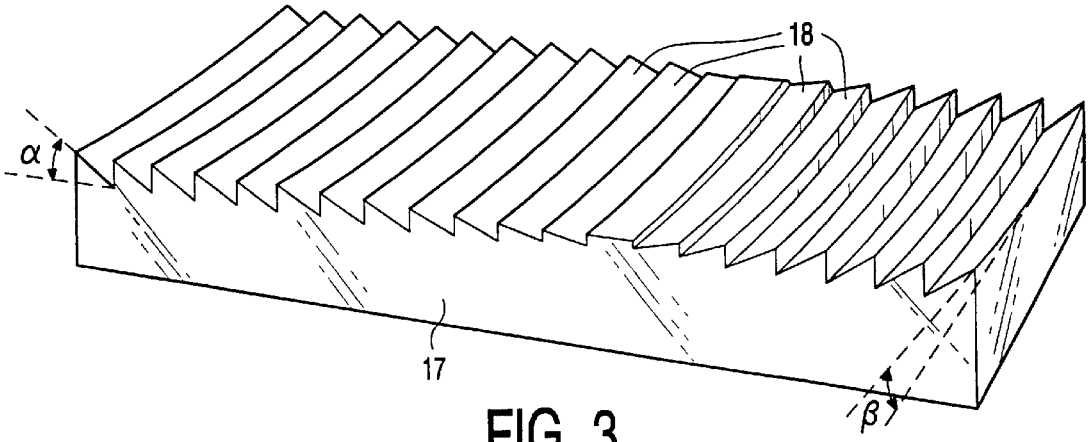
FIG. 3 shows an optical element.

FIG. 3 shows a rectangular optical element 17 which can be applied in the invention. Said optical element 17 is comprised of a flat plate of a transparent material wherein a row of prisms 18 is provided on one side by means of milling. These prisms 18 may also be provided on both sides of the optical element. At each milling location, the surface of the optical element has an angle $\alpha$ which is different for each prism 18, and an angle $\beta$ which varies, along the length of a prism 18, in accordance with a certain function, so that the prism, viewed in a direction in the plane of the optical element, is curved. The direction wherein the light from the LED is deflected thus depends upon the location where the light ray enters the optical element. The angles $\alpha$ and the variation of the angle $\beta$ are calculated by means of a computer from the required light pattern to be generated on the object to be illuminated. This pattern may be very complex; it has even been found possible to project text by means of such optical elements.

Such an optical element, or a matrix for such an element, can be readily manufactured by clamping a rectangular piece of material on a milling machine at a certain angle $\alpha$ and subsequently milling out a first prism, whereby the milling cutter follows a path which determines the variation of the angle $\beta$. Next, all subsequent prisms are milled out in a corresponding manner.

Figure 4:
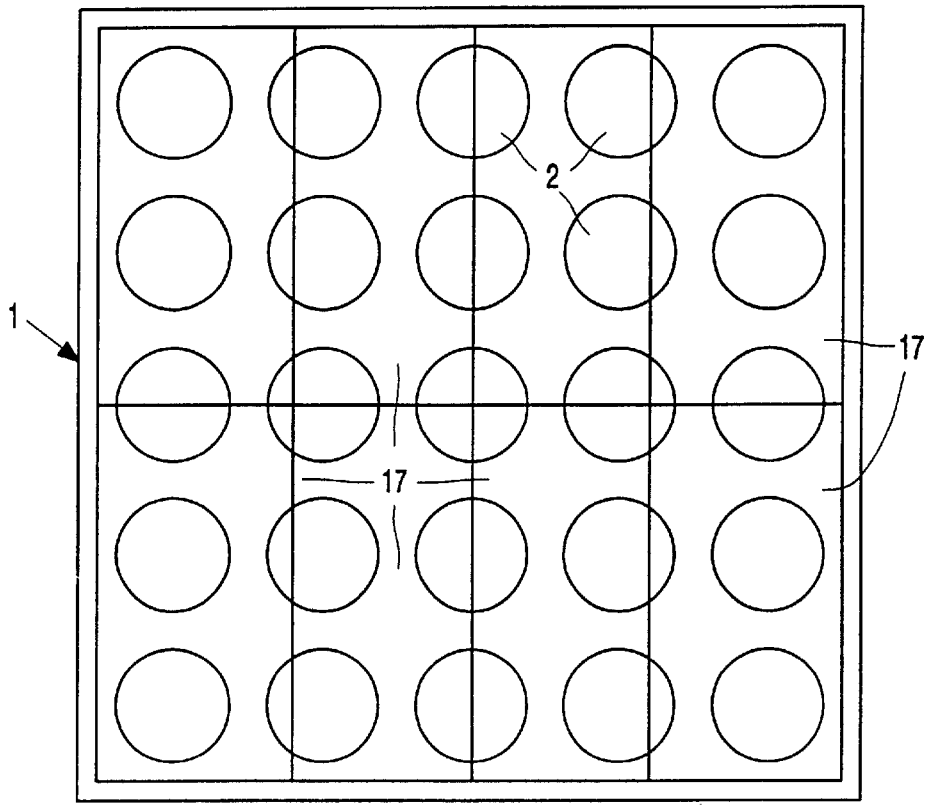
FIG. 4 is a diagrammatic plan view of a luminaire.

In accordance with FIG. 4, 25 LED modules 2, as shown in FIGS. 1 and 2, are arranged in a 5×5 matrix in a housing. In this case, however, the cover is not formed by a corresponding 5×5 matrix of lenses but by a 2×4 matrix of identical, rectangular optical elements 17 as shown in FIG. 3.

If the number of rows and columns of the light source matrix is referred to as, respectively, $Ns_r$ and $Ns_c$, and the interspace between the LEDs in both directions is referred to as, respectively, $Ws_r$ and $Ws_c$, and the number of rows and columns of the lens-matrix is referred to as, respectively, $Nl_r$ and $Nl_c$, and the dimensions of the optical elements are referred to as, respectively, $Wl_r$ and $Wl_c$, then the following equation applies, provided both matrices have the same dimensions:

$$Ns_r \times Ws_r = Nl_r \times Wl_r$$

$$Ns_c \times Ws_c = Nl_c \times Wl_c$$

which determines the relationship between the dimensions of the optical elements and the distance between the LED modules.

In this exempla, the following applies:

$Ns_r=5$, $Ns_c=5$, $Nl_r=2$ and $nl_c=4$.

Figure 5:
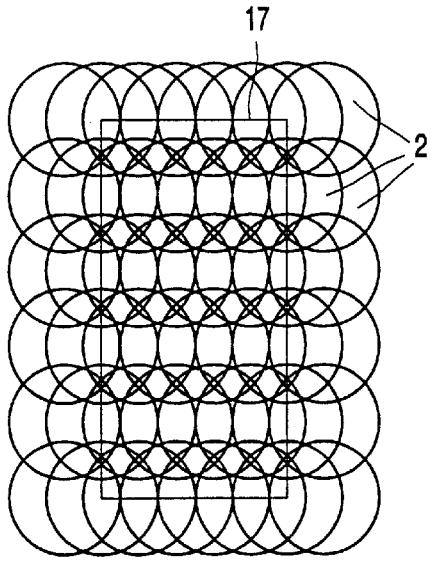
FIG. 5 diagrammatically shows the effect of the luminaire shown in FIG. 4.

As a result of such an arrangement, the LED modules 2 are always in a different position with respect to an optical element 17, and the effect of this arrangement is comparable to the effect obtained if all LED modules would be positioned, with very little interspace, behind one optical element 17, as is shown in FIG. 5. This arrangement, however, would be physically impossible due to the dimensions of the LED modules 2. In this manner, a very uniform illumination of the optical element 17, and hence a very uniformly distributed light beam, are achieved.

The intended result can be achieved by choosing the number of rows and columns of the LED matrix and the lens matrix to be different, i.e. $Ns_r \neq Nl_r$ and $Ns_c \neq Nl_c$, an optimum result being theoretically obtained by choosing the number of rows and columns such that the difference between them is only 1. Production-technical reasons, however, may argue in favor of different numbers.

What is claimed is:

1. A luminaire comprising:

a set of light sources predominantly situated in a first plane; and a set of optical elements predominantly situated in a second plane which is substantially parallel to the first plane;

wherein the position of a portion of a first optical element underlying a first light source differs from the position of a portion of a second optical element underlying a second light source; and wherein the set of light sources and the set of optical elements each form a matrix, which matrices have substantially equally dimensions, while the number of rows and/or columns of the two matrices are different.

2. A luminaire as claimed in claim 1, wherein the number of rows and/or columns of one matrix exceeds the number of rows and/or columns of the other matrix by at least one.

3. A luminaire as claimed in claim 1, wherein each of the light sources comprises a light emitting diode and a collimator lens, wherein the collimator lens bring light rays emitted from the light emitting diode into a substantially parallel beam by one or more of reflection and refraction.

4. A luminaire as claimed in claim 1, wherein the light sources are light-emitting diodes (LEDs).

5. A luminaire as claimed in claim 1, wherein the optical elements are rectangular.

6. A luminaire as claimed in claim 1, wherein the optical elements border on each other over at least a part of their circumference.

7. A luminaire as claimed in claim 1, wherein each of the optical elements comprises a first surface and a second surface opposite the first surface, wherein at least a portion of one of the first surface and the second surface is provided with facets having different angles of inclination.

8. A luminaire as claimed in claim 7, wherein said at least one of the first surface and the second surface of each of the optical elements has a sawtooth structure, the facets being formed by substantially parallel prisms.

9. A luminaire as claimed in claim 1, wherein each of the optical elements in the set of optical elements has a substantially identical shape.

10. A method of illuminating an object using a luminaire comprising a set of light sources arranged predominantly in a first plane, and a set of optical elements arranged predominantly in a second plane substantially parallel to the first plane, wherein the position of a portion of a first optical element underlying a first light source differs from the position of a portion of a second optical element underlying a second light source, and wherein the set of light sources and the set of optical elements each form a matrix, which matrices have substantially equally dimensions, while the number of rows and/or columns of the two matrices arc different, the method comprising:

positioning the luminaire over the object; and activating the light sources.

11. A method as claimed in claim 10, wherein each of the optical elements comprise a first surface and a second surface and are provided, on at least one of the first surface and the second surface, with a plurality of facets, each of the facets having an angle of inclination relative to one of the first and second surfaces, said angles of inclination being selected to form a predetermined illumination pattern with which the object is to be illuminated.

* * * * *